US005779875A

United States Patent [19]

Budaev et al.

[11] Patent Number: 5,779,875

[45] Date of Patent: Jul. 14, 1998

[54] METHOD FOR FEEDING LOOSE MATERIAL INTO AN ELECTROLYZER FOR PRODUCTION OF ALUMINUM

[75] Inventors: Jury Alexeevich Budaev, Russian Federation, Irkutsk, ul. Baykalskaya d.224,kv.13; Viktor Konstantinovich Kazantsev; Jury Petrovich Shelkovnikov, both of Irkutsk; Igor Samsonovich Grinberg, Irkutskaya obl.; Sergey Kokhanovsky, Irkutskaya obl.; Vladimir Iliich Skornyakov, Irkutskaya obl.; Petr Ivanovich Elagin, Irkutskaya obl.; Leonid Viktorovich Ragozin, Irkutskaya obl., all of Russian Federation

[73] Assignee: Jury Alexeevich Budaev, Russian Federation

[21] Appl. No.: 766,414

[22] Filed: Dec. 12, 1996

[30] Foreign Application Priority Data

Dec. 13, 1995 [RU] Russian Federation ..... 95121030
Aug. 30, 1996 [RU] Russian Federation ..... 96116728

[51] Int. Cl.[6] ..... C25C 3/14

[52] U.S. Cl. ..... 205/392; 204/245

[58] Field of Search ..... 205/392; 204/245

[56] References Cited

U.S. PATENT DOCUMENTS

| | | | |
|---|---|---|---|
| 2,713,024 | 7/1955 | Mantovanello | 205/392 |
| 5,378,326 | 1/1995 | Kumpulainen | 204/67 |
| 5,476,574 | 12/1995 | Welch et al. | 205/392 |

FOREIGN PATENT DOCUMENTS

| | | |
|---|---|---|
| 1338302 | 8/1963 | France . |
| 1495653 | 8/1967 | France . |
| 2036896 | 12/1970 | France . |
| 56-18677 | 4/1981 | Japan . |
| 126271 | 3/1959 | U.S.S.R. . |
| 458624 | 2/1975 | U.S.S.R. . |
| 1488365 | 6/1989 | U.S.S.R. . |

*Primary Examiner*—Donald R. Valentine
*Attorney, Agent, or Firm*—Ostrolenk, Faber, Gerb & Soffen, LLP

[57] ABSTRACT

The method includes the following step of forming at least one material input zone on the surface of an electrolyte, disposing a working tool in the input zone to push the material into the melt of the electrolyte, imparting mechanical oscillations and translatory motions to the working tool in the direction towards the electrolyte and back therefrom with the length of said motions being within the range of values from about 10.0 to about 120.0 sec. The method further includes transporting material into the input zone and forming some layer in the material input zone, and after accumulation of a sufficient amount of the material, the latter enters into contact with the working tool. The aforesaid steps increase the capacity of the material input zone and reduce power expenditures on the input of material into the electrolyte.

5 Claims, 2 Drawing Sheets

METHOD FOR FEEDING LOOSE MATERIAL INTO AN ELECTROLYZER FOR PRODUCTION OF ALUMINUM

FIELD OF THE INVENTION

The invention relates to the field of electrolytic production of aluminum, and more exactly to a method for feeding material into a melt of electrolyte.

The instant invention can be most successfully used on electrolyzers with a self-baking anode which use the "Eru-Khola" process.

DESCRIPTION OF THE PRIOR ART

At present the production of aluminum using electrolyzers with a self-baking anode is for the most part conducted using a method for feeding material into the electrolyzer consisting of periodically destroying a substantial portion of the peripheral crust of the electrolyte, for example, once every 2–3 hours, with the subsequent addition of an uncontrolled portion of fresh material onto the opened space between the side of the electrolyzer and the anode. As a rule, these steps are carried out with mobile mechanisms which sequentially process electrolyzer after electrolyzer, or with stationary piercing-loading devices (for example, of the beam type). Such a method for feeding stock into the electrolyzer is characterized by unsatisfactory ecologcal and technological indexes, since frequent destructions of a substantial portion of the electrolyte crust are accompanied by the discharge of fluorine compounds and alumina into the atmosphere, which results in an increase in the consumption thereof and the appearance of technological disturbances in the process of electrolysis, since a large single portion of material fed into the melt of the electrolyte, e.g. 10–12 portions per day, sharply cools the melt and increases the concentration of $Al_2O_3$ therein. A sharp, abrupt change in the concentration of almina in the electrolyte results on the one hand in the formation of an insoluble residue of material on the bottom of the cathode device, and on the other hand in an overconsumption of electric power as a result of an increased number of anode effects. Furthermore, since this method for feeding material into the electrolyzer does not make it poossible to control the concentration of alumina in the electrolyte, it does not make it possible to optimize the process of electrolysis and achieve minimum cost of the obtained aluminum. The efficiency of the process of producing aluminum in that case corresponds to the values 0.84–0.89 as compared with the possible 0.9–0.95.

In view of the more strict ecological requirements in respect of the production of aluminum, and also in view of the necessity for intensification of that production process, efforts of designers are directed to the improvement of the electrolysis process by more uniform and optimum feeding of stock to the electrolysis baths, in particular to the development of methods for spot (local) feeding of the material, which do not provide for opening the electrolyte crust and make it possible to carry out the electrolysis process in an automatic mode.

A method is described in French patent No. 1495653 for spot (local) feeding of material, which method is ensured by mechanisms of periodical action which are stationarily mounted to break the electrolyte crust over a small area and to feed a portion of material preliminarily heated on the crust into the formed break. After piercing these areas with hammers, a repeated loading of alumina is effected from a vessel delivered on an automatically controlled carriage or crane, the movements of which are synchronized with a program controlling the break-down hammers. According to this method, the periodicity of breaking the crust and feeding portions of the material is 15–90 minutes.

In spite of the presence of some positive features, the aforesaid French patent has not found wide use with electrolyzers with a self-baking anode because account is not taken therein of the kinetics of the growth and hardening of the electrolyte crust, which depends on the physicochemical and geometric conditions of its formation. In particular, feeding a portion of cold material, even in the lower limit of the cited range, e.g. 15 minutes, is taken by the electrolyte in the local zone in which the material is inputted as thermal shock, resulting in the emergence of an electrolyte crust at this spot, which slows the input of material into the electrolyte by a substantial degree and its dissolution becomes irregular in time. Because of this, expensive, powerful mechanisms, capable of developing substantial forces are used in practice to ensure the breakdown of the formed crust, which increases the cost of the produced aluminum.

Attempts to ensure a more uniform, almost continuous supply of alumina to the aluminum electrolyzer resulted in the emergence of the method according to USSR Inventor's Certificate No. 458624, in accordance with which stock is fed into the electrolyzer every 2–6 minutes in small portions of 1–3 kg. A portion preliminarily heated on the crust of the electrolyte is immersed in the electrolyte by single or multiple breakdown of the crust by means of breakdown devices stationarily mounted on each electrolyzer and remote controlled.

Ensuring a more uniform supply of material into the melt of the electrolyzer, nevertheless this method is not widely used since, when it is realized, a crust braking the process of dissolution of the material is produced on the surface of the electrolyte in the input zone at the begining of each feed cycle in order to ensure preliminary heating of the next portion of stock. The formation of the crust is especially rapid in electrolyzers with a self-baking anode when the stock input zone is peripherally positioned as compared with electrolyzers provided with burnt anodes and central positioning of the input zones. Therefore, pneumatic cylinders of large diameters of 150–200 mm and substantial working pressure of the compressed air equal to 0.7–0.8 MPa are also required to break it.

In the foregoing methods, the capacity of the material input zone does not correspond to the maximum value because of the formation of a crust, separating the stock from the melt, as a result of which the speed at which the stock is inputted into the melt is substantially reduced.

The capacity of the material input zone is meant to mean the value corresponding to the consumption of material in a unit of time, which on the one hand does not result in the "freezing" of the input zone and accumulation on the crust of stock which does not participate in the electrolysis during a predetermined interval of time, and on the other hand determines the optimum number of supply spots on a concrete electrolyzer in accordance with its productivity.

The zone capacity depends on a number of technological, physicochemical and geometrical parameters of the melt in the area of the input: temperature, cryolite ratio, electrolyute splashes, its level, stock dosage, the presence and speed of circulation flows of the melt, etc. Since almost all the aforesaid parameters are unstable in time, the magnitude of the zone capacity even during a 24-hour period can differ substantially from the average value. In turn, this average value to a substantial degree depends on the method and apparatus for input of the material into the electrolyte.

Furthermore, the zone capacity to a substantial degree depends on the type of stock obtained by different technological processes—finely divided or macrocrystalline—which is used in this concrete production process.

It follows from the aforesaid that it is most advisable to feed the material into the input zone in small portions and accordingly, more often, without allowing a crust to be formed on the electrolyte.

The large number of parameters of the electrolyte melt, which make the input of material into the electrolyzer more complicated, makes it necessary for designers to increase the number of zones for input of the material, which are distributed over the perimeter of the anode, and thus to reduce the portion of material inputted through one zone. In particular, according to French patent No. 2036896, in order to load the electrolyzer uniformly with material, breaking the crust and inputting the alumina into the pierced opening are effected simultaneously in two spots symmetrically positioned relative to the longitudinal axis of the anode.

Wherein, in the first period the crust of the electrolyte is broken between the end face of the anode and corresponding end face of the cathode at uniformly spaced spots, then during the second period the crust is broken at spots uniformly positioned along the longitudinal sides of the bath, and finally during the third period alumina is continuously loaded into the spots broken during the second period.

Under conditions of insignificant turbulence of the melt, which is characteristic for electrolyzers with burnt anodes, an increase in the number of input zones ensures the supply and dissolution of the necessary volume of material into the electrolyzer along the periphery of the anode. However, the use of such a method requires complex equipment and does not conform with ecological requirements, since it only slightly differs from the conventional method for feeding material into an electrolyzer with mobile machines.

Another way of increasing the efficiency of feeding material into a melt of electrolyte is related to attempts to increase the maximum capacity of the zones for input of material into the electrolyzer. Thus, according to USSR Inventor's Certificate No. 1488365, in order to increase the capacity of the of the material input zones by preliminarily heating the material with gases discharged in the zone of the anode, the aforesaid zones are disposed in the anode. In order to accomplish this the anode casing is divided into sections, between which bunkers with the material—alumina—are mounted. However, realization of this method is difficult because of the necessity of changing existing constructions of casings of the anodes, the complexity of their design and manufacture because the inner parts of a sectional anode casing due to the higher temperatures present in the process of operation have a more limited service life as compared with the external parts.

In Japanese application No. 56-18677, in order to increase the capacity of each material input zone, they are disposed in the central part of the anode, in which division of the horizontal circulating flows of the melt of electrolyte is effected into flows directed along the longitudinal sides of the anode. In the zones of division the material is most intensively taken from the zone of its input into the melt which is in the space between the poles.

Positioning the material input zones in the self-baking anode is characterized by the following drawback: very large capital expenditures, related to the necessity for modernization of the constructions of the anodes, are required for its realization. Therefore in order to supply the electrolyzer along the periphery of the monolithic anode and to minimize the number of material input zones, actions are provided which increase their capacity.

Thus, according to French patent No. 1338302, a mixture of gas with material, primarily alumina, is applied onto the surface of the electrolyte adjacent the anode by a continuous or pulsating stream under pressure. This causes oscillations of the surface of the melt, which hinder the formation of a crust on the electrolyte. This method has not found wide use because of the large carry-off of dust, the complexity of feeding gas to the material input zone, and also the problems related to removal of the additionally appearing volume of gas.

Another attempt to increase the capacity of the material input zone was proposed in USSR Inventor's Certificate No. 126271.

Described therein is the supply of alumina in the process of electrolysis with the use of a method of vibration in order to accelerate the dissolution of aluminum oxide in the melt of electrolyte and prevent the formation of a residue on the bottom. The method is effected by using a spherical reservoir with apertures which is immersed in the melt of the electrolyte and subjected to horizontal vibration. The aluminum oxide in the spherical reservoir is under the effect of the vibration and dissolves in the melt. This method has not been realized in practice because it is difficult to keep the surface of the electrolyte open at the spot of alumina input, since a crust is very rapidly formed on the surface of the melt when there is contact between the cold alumina and the melt.

Furthermore, a stationary positioning of the vibrating tool did not take into account the possibility for the crust of electrolyte to appear at different levels because of the constantly changing thickness of the layer of the electrolyte in the bath, for example, as a result of adjustment of the distance between the poles of the efectrolyzer. Furthermore, it is assumed that the vibrating tool is constantly in the melt of the electrolyte, and this has a negative effect on its service life.

The next attempt to increase the capacity of the material input zone resulted in the development of the method according to U.S. Pat. No. 5,378,326. In accordance with that method, the material is inputted into the bath through a guide box passing through the crust, wherein the lower edge thereof is positioned above the melt of the electrolyte. A vibrating tool passes inside the box, which tool is made to effect mechanical oscillations with a vertical amplitude of 0.5–1.5 cm and frequency of 11–40 Hz. After material has accumulated in the guide box, the vibrating tool begins to contact therewith and push it into the melt with the formation of an opening in the crust. The method provides for displacing the vibrating tool relative to the melt of the electrolyte every 30–60 minutes to maintain the aforesaid opening in the crust open.

Tests of this method have shown that it has low efficiency, and therefore it is not widely used. First of all this is due to unacceptably large nonproductive energetical expenditures, related to, as it turned out, not so much the pushing of the material into the electrolyte as the overcoming of the jamming of the tool in the guide box because of the narrowing of its passage section, for example, as a result of electrolyte getting inside it, or because of electrolyte sticking on the tool, which finally results in a jamming of the tool in the guide box and a stop of the movement of material into the melt. In particular, the inventor of the invention himself points out to this difficulty, justifying the use of very high values of the amplitude range of vibrations of the tool.

The 30–60 minute time interval for reciprocal-translatory motion of the tool shows that most of the time the tool is vibrating when it is spaced from the surface of the melt. Such a mode of operation of the tool promotes the formation of a crust of electrolyte under it, which hinders the movement of the material into the electrolyte, promotes its accumulation on the crust and in the guide box, which results in jamming of the instrument and a stoppage of material supply. This takes place because of the high damping properties of the layer of loose material which make it difficult to transmit the vibration field into the zone of formation of electrolyte crust. Therefore the claimed time interval of reciprocal-translatory motion does not promote the achievement of a maximum capacity of the material input zone because of the necessity to overcome substantial forces when pushing the column of material into the melt of the electrolyte and requires large amplitudes of vibration of the tool (0.5–1.5 cm), which results in unproductive expenditures of power.

Furthermore, with the indicated form of oscillations of the working tool—rapid movement downwardly, slow movement upwardly—a portion of the material may move in a direction away from the electrolyte. Therefore, the high value of peak-to-peak oscillations 2A of the vibrating tool in the guide box, which is 1.0–3.0 cm, together with the defined range of frequencies and form of its movement even promote braking of the loose material in the box, since with certain values of the intensity of vibration the gravitational effect becomes insufficient for forward movement of the material downwards. Braking the transport of the material in the guide box itself may even occur in the case of an electrolyte surface free of crust, as if there were a reduction of its pass section, which in the proposed method may take place in an avalanche-like manner.

Thus, the essence of the proposed method in practice is only slightly distinctive over the earlier described methods: an electrolyte crust is formed in the material input zone, then after 30–60 minutes it is broken. Here vibration only plays an ancilliary role, reducing the force of friction in the guide box, which the inventor contends results in a reduction of power consumption. The capacity of a material input zone working in accordance with this method is very low, during a large portion of the claimed reciprocal-translatory motion time period of operation of the tool, the material lies on the crust and does not participate in the electrolysis process even when there is continuous feeding of stock into the upper part of the guide box. This can cause an undesirable anode effect. When there are four zones for input of the material-alumina into an electrolyzer with an applied current intensity of 165 kA through one zone, it is necessary to input about 400 g of alumina per minute. The weight of the alumina for 20–40 minutes is 8–16 kg. When the density of alumina approximately corresponds to unity, its volume will correspond to the volume of the guide box. It is obvious that for one push movement, the aforesaid amount of alumina cannot be loaded into the electrolyte, since the density of the melt exceeds the density of the alumina by more than 2 times. It follows therefrom that after several cycles the guide box will be overfilled, and restriction of the capacity of the material input zone by at least several times will occur. As a result, as a rule, jamming of the tool will occur.

Positioning the lower part of the guide box in the crust of the electrolyte, in accordance with the patent, may result in complete stoppage of the feeding of material into the melt, since when the anode is lowered during the recovery of the metal or adjustment of the spacing between the poles, the level of the electrolyte may rise to such an extent that it penetrates into the guide box and hardening, "brakes" the tool without the possibility of rapid restoration of the serviceability of the input zone.

The frequency band claimed in the patent corresponds to frequencies of general-industrial pneumatic, e.g. valve, engines and is a readily available level of engineering. An effect of the vibration frequency of the tool, which is claimed in the patent, on the supply of alumina into the electrolyte is doubtful, even with indication of additional information relating to the intensity of the process. The lower limit of the claimed frequency band does not conform with modern-day knowledge regarding the hygiene of a human being, since the resonance frequencies of a person's organs lie in the range to 20 Hz and higher. Therefore it is more advisable to effect suppression of detrimental oscillations in the air and in the support constructive members of the electrolyzers by means of dampers and vibration damping insulation, and not select different vibration frequencies for each supply mechanism. With regard to the upper limit of the vibrator frequency, even in combination with the claimed amplitude range (A=0.5–1.5 cm), it is not possible, as already noted, to determine from the specification of the patent whether the level of intensity of the process remains constant and what its absolute value is.

There are also doubts with regard to the inventor's contention that the supply spots according to this method may be positioned at any point on the periphery of the anode. In particular, in the transverse section of the electrolyzer fragment shown in the patent, the material is fed into a very badly chosen zone adjacent the vertical border of the liquid and solid phase of the electrolyte, which in the case of a constant supply of cold material begins to move toward the anode and closes the supply of stock into the electrolyte.

The aforesaid serious drawbacks of the method of vibrational pushing of material through a guide box into the electrolyte are to a substantial degree removed, if no use is made at all of a guide box and the material is fed into the electrolyte by freely falling into the space of a gas-collecting bell.

Thus, it is obvious that not one of the known methods ensures reliable and economical input of material into the electrolyzer, since some of the material input zones can be "hot," with an open, splashing surface of the electrolyte; others—"cold," covered with a layer of loose stock; a third group—solidified, covered with a crust of electrolyte, spaced at different levels relative to the surface of the electrolyte etc. The physical state of the material input zone in the end determines its capacity and depends on a number of physicochemical parameters of the electrolyte—level, temperature and cryolite ratio, volume of the buildup, the presence and amount of coal foam, and also the magnetohydrodynamic and gasohydrodynamic melt modes determining the power and spatial positioning of the circulating flows in the volume thereof, the quality, temperature and volume of the material fed into the input zone, the geometrical positioning of the material input zone on the electrolyzer, the presence and intensity of mechanical actions on the material in the input zone, e.g. by means of a working tool, etc.

SUMMARY OF THE INVENTION

The object of the present invention is to increase the productivity of an electrolyzer with a self-baking anode to produce aluminum by creating a reliable, ecologically pure and economical method for feeding loose material thereinto, in which due to an increase of the capacity of the material input zones and its uniform supply into the melt, an increase in the productivity of the electrolyzer would be achieved with minimum power expenditures.

In accordance with the foregoing and other objects the essence of the present invention is that in a method for feeding material into an electrolyzer for production of aluminum, including transporting loose material into at least one input zone, where a layer of loose material is formed after accumulation therein of a sufficient amount of the aforesaid material, the latter enters into contact with a tool effecting mechanical oscillations to push the material into the layer of the electrolyte, as a result of which a vibration field is created in the aforesaid layer which prevents the formation of a crust on the electrolyte, and translatory motion towards the electrolyte and back therefrom, in accordance with the invention, the length of the translatory motions of the tool in the direction towards the electrolyte and back therefrom lies in the time range of from about 10.0 to about 120.0 sec.

The aforesaid time range of displacement of the vibrating tool relative to the surface of the melt increases the capacity of the material input zone and ensures its uniform supply into the melt of the electrolyte. The indicated time range shows the increasing frequency of immersion of the vibration tool into the layer of loose material, in which a vibration field is more often created which disturbs the links occurring during hardening of the electrolyte in the material input zone, and thus maintains the input zone unfrozen. In addition to this the vibration field improves the wettability of the particles of the loose material in the electrolyte, which increases the speed of its dissolution and accordingly the capacity of the input zone increases. Furthermore, the particles of material which is in a vibrofluidized state are intensively heated by hot anode gases, which results in a reduction of the temperature drop in the layer of material in the input zone, preventing its "freezing." All of the foregoing provides for uniform input of material into the melt of the electrolyte and its high rate of input.

In the case when the length of translatory motion of the tool in the direction towards the electrolyte and back therefrom is less than 10.0 sec, nonproductive expenditures of power on the displacement of the tool increase, while an increase in the capacity of the material input zone is not observed.

In the case when the length of translatory motion of the tool in the direction towards the electrolyte and back therefrom is greater than 120.0 sec, a vibration field is more rarely created in the layer of material in the input zone, which increases the probability of its "freezing." This disturbs the uniformity of the feeding of loose material into the melt of the electrolyte, reduces the speed of its input and reliability of the method.

It is advisable that the input zone for the loose material be positioned in the melt of the electrolyte above the region of maximum thickness of the electrolyte, which is found along each side wall of the anode of the electrolyzer and is limited relative to its transverse axis on both sides by one-sixth of its length.

Fulfillment of this condition is also directed to an increase of the capacity of the material input zone, since the volume of the electrolyte is maximum above the metal in those regions because of the curvature of its surface, which is due to interaction of the magnetic field, occurring around the vertical parts of the busbars of the electrolyzer through which a large current is applied to the electrolyzer, with that same current flowing through the melt. Furthermore, positioning the material input zones in the aforesaid region promotes maintenance of a side buildup protecting the lining of the electrolyzer from breakdown.

Furthermore, the release of CO and $CO_2$ gases occurs most intensively in those regions, and they cause substantial turbulence of the melt which promotes rapid dissolution of the material and equalization of its concentration within the volume of the melt.

When the material input zone is selected outside the aforesaid values of ±⅙, its capacity sharply drops because of the slight turbulence of the melt, which is due to the small release of gases, and the presence of a coal foam on the surface of the electrolyte which hinders the feeding of material therein.

It is recommended that the amplitude of vertical mechanical oscillations of the tool be maintained within the range of from about 1.0 to about 5.0 mm, since this range of amplitudes is sufficient for effective pushing of the loose material through the opening in the crust of the electrolyte in the material input zone.

Mechanical oscillations of the tool in the indicated range of amplitudes require a small power consumption and sharply increase the service life of the mechanism providing the mechanical oscillations.

When the amplitude of the mechanical oscillations of the tool is increased to more than 5.0 mm, there is an increase of nonproductive power consumption with only a slight increase of the capacity of the material input zone.

When the amplitude of mechanical oscillations of the tool is reduced to less than 1.0 mm, a reduction of the vibration field in the layer of material occurs, which results in a substantial reduction of the capacity of the material input zone.

BRIEF DESCRIPTION OF DRAWINGS

Other objects and advantages of the invention will become more evident from the following concrete examples of its realization and drawings, in which.

DETAILED DESCRIPTION OF THE INVENTION

Figure 1:
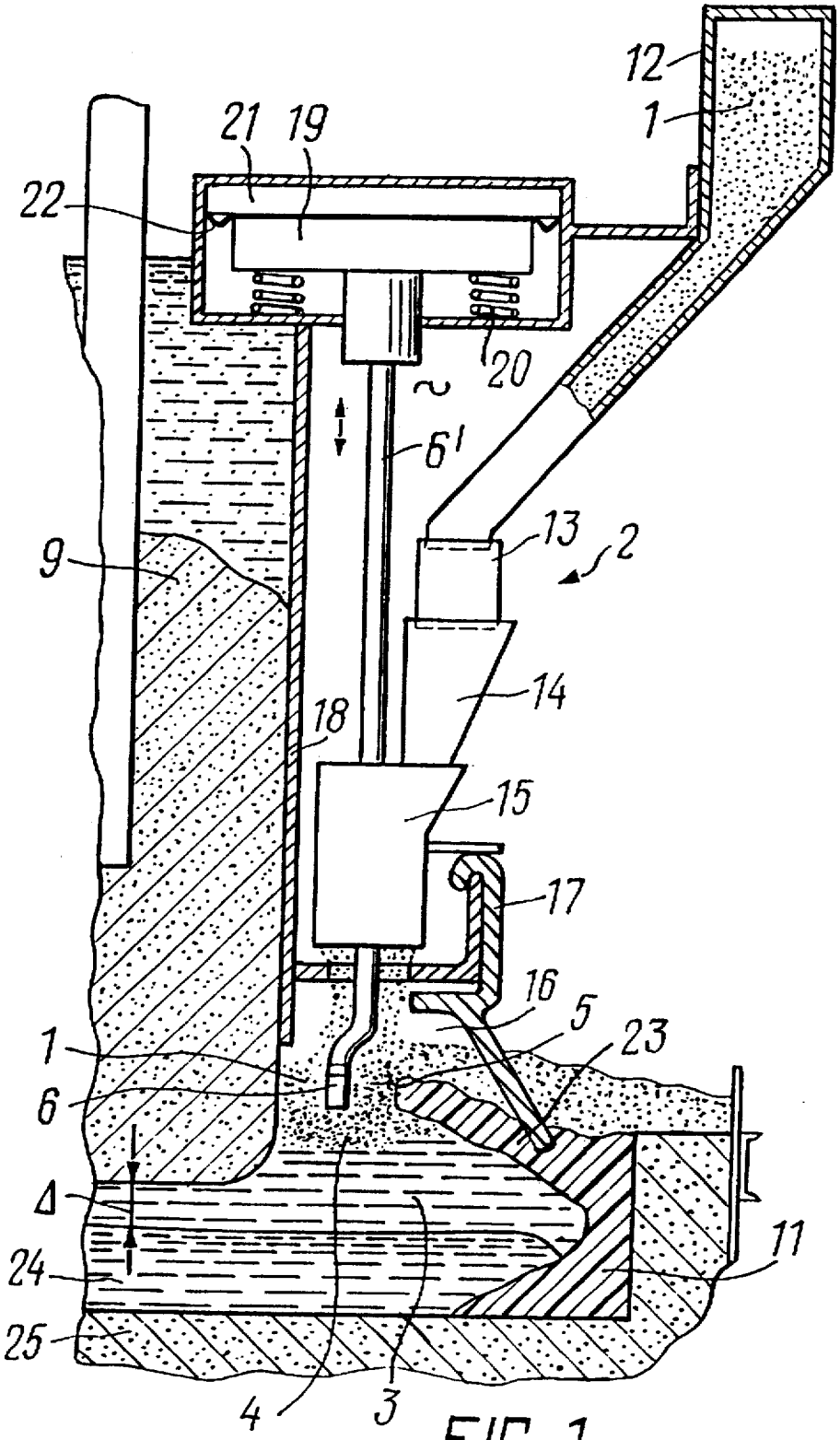
FIG. 1 schematically shows a device for realization of the method for feeding material into an electrolyzer for the production of aluminum in accordance with the invention, with a cut-away sectional view.

The method for feeding loose material, for example, alumina into an electrolyzer for the production of alumninum, in accordance with the invention, includes transporting loose material 1 (FIG. 1), by which we mean powder-like or granulated material, through at least one zone, for example, three zones 2, 2', 2" (FIG. 2) for transporting to the electrolyte 3, from which zones it enters input zones 4, 4', 4", where a layer 5 of the material 1 is formed in each input zone on the surface of the electrolyte 3. A tool 6 is brought to the material 1, which tool effects translatory motion towards the electrolyte 3 and back therefrom to push the material 1 into the layer of the electrolyte 3 and performs mechanical oscillations in a vertical plane with an amplitude of about 1.0 to about 5.0 mm. The length of time the translatory motions of the tool 6 lies in the range of values from about 10.0 to about 120.0 sec.

Figure 2:
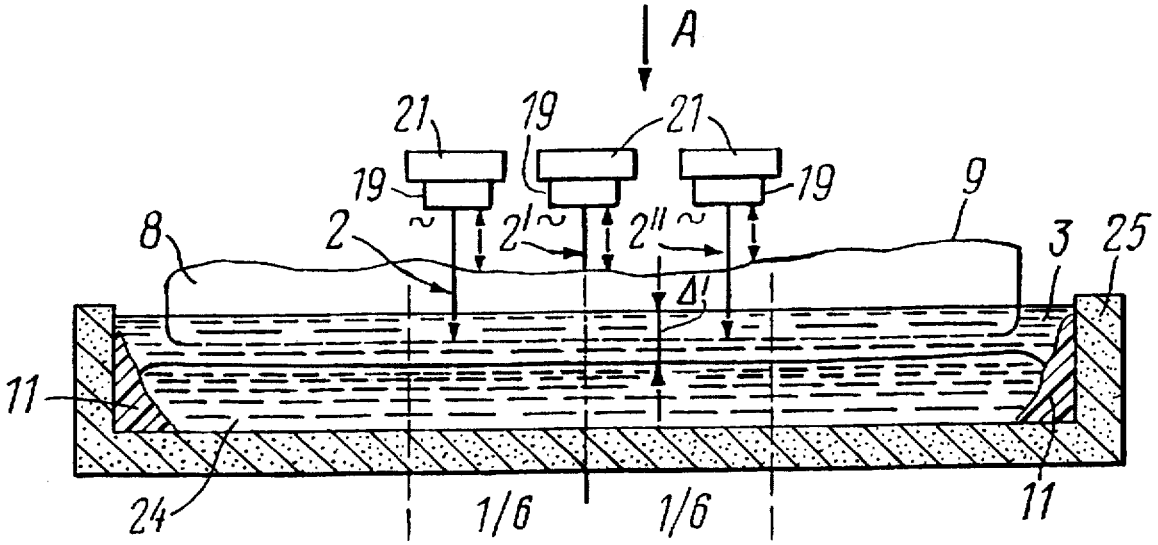
FIG. 2 is a variant of realization of the method, in accordance with the invention, a longitudinal sectional view.
Figure 3:
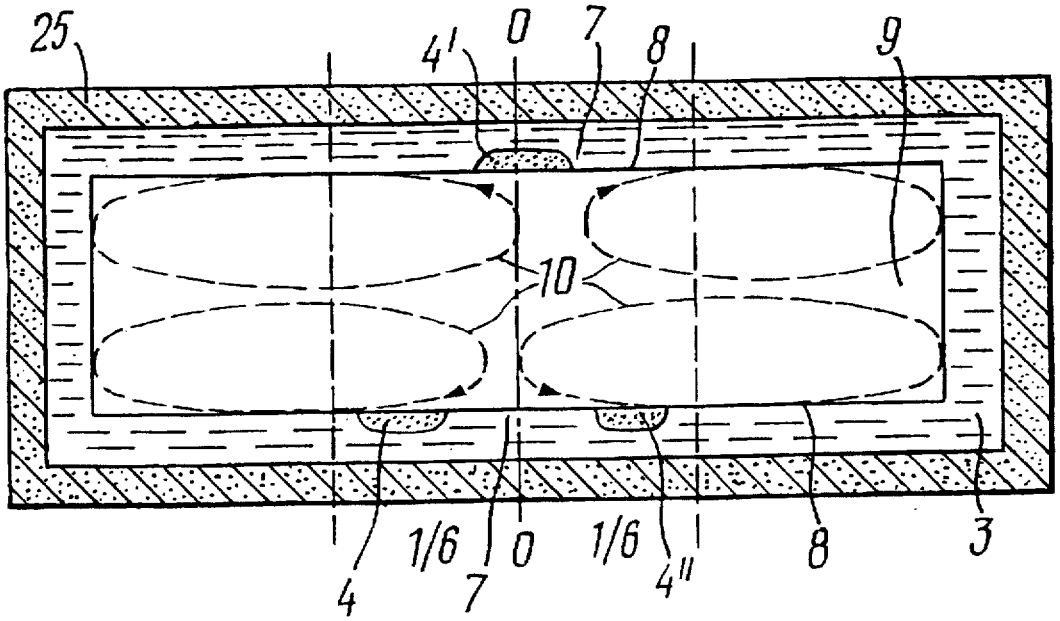
FIG. 3 is a view along arrow A in FIG. 2 with circulatory flows of electrolyte and material input zones.

In order to increase to an even greater degree the capacity of each material 1 input zone 4, 4', 4", these zones 4, 4', 4" should be positioned above region 7 (FIG. 3) with the greatest thickness Δ' (FIG. 2) of the layer of electrolyte 3. This region 7 is positioned along each side wall 8 of the anode 9 and is limited on both sides relative to the transverse axis O—O of the electrolyzer by one-sixth of its length. The material 1 fed into that region 7 is rapidly introduced into the melt of the electrolyte due to its intensive turbulence caused by the release of gases CO, $CO_2$ and others from under the anode 9. Increased turbulence of the melt of electrolyte 3 results in freeing its surface in the aforesaid region from coal dust (not shown in the drawings) which is accumulated in the corners and end faces of the electrolyzer, this increasing the capacity of each material 1 input zone 4, 4', 4". Furthermore, the dissolution of the material 1, coming from the input zones 4, 4', 4", in the electrolyte 3 in the aforesaid region 7 takes place more intensively due to the electrolyte, overheated by several degrees and to a great degree impoverished with aluminum oxide, coming from the central portion of the space Δ between the poles (FIG. 1) of the electrolyzer (FIG. 1), which results in an increase in the capacity of the material 1 input zones 4, 4', 4" (FIG. 3). The input of material 1 in the aforesaid regions 7 (FIG. 3) results in better equalization of its concentration in the melt and of the temperature of the electrolyte due to the presence therein of not only vertical turbulence with gases, but also horizontal, slower circulatory flows 10 of the melt of the electrolyte 3, due to interaction of the magnetic field produced around the vertical portions of the busbar (which are not shown in the drawing) of the electrolyzer, through which large value electric current is applied to the electrolyzer, with the same current flowing through the melt of the electrolyte 3. These flows 10 also emerge from under the anode 9 in the aforesaid regions 7 where the material 1 input zones 4, 4', 4" are disposed, which promotes maintenance of a uniform side buildup 11 (FIG. 1).

The method described above is realized, for example, in an apparatus in which each zone 2 (FIG. 1) for transport of alumina is formed by a bunker 12 communicating with a doser 13 which in turn through a pipeline 14 is connected to a material 1 input device 15 in a space 16 of a gas-collecting bell 17. The aforesaid elements for transport of the material 1 are secured to a casing 18 of the anode 9 of the electrolyzer.

In order to create the tool 6 for mechanical osillations, a vibrator 19 of the autogenerating principle of action is provided to which the tool 6 is rigidly connected by one end 6'. The aforesaid vibrator 19 is freely mounted on compression springs 20 abutting against the casing 18 of the anode 9. In order to impart translatory motion to the tool 6, a known membrane pneumatic mechanism 21 is provided which is rigidly connected to the casing 18 of the anode 9 from one side, and from the other is connected by the membrane 22 to the vibrator 19.

The zone 4 for input of the material 1 into the electrolyte 3 is positioned adjacent the anode 9 in crust 23 of the electrolyte 3, which crust is positioned in the space 16 of the gas-collecting bell 17 secured to the casing 18 of the anode 9 immersed in the electrolyte 3. The anode 9 and liquid aluminum 24 positioned in cathode space 25 form the gap Δ between the poles. The lining of cathode device 25 is protected by the buildup 11. The space Δ between the poles is filled with electrolyte 3 in which the process of electrolysis takes place.

The apparatus described above operates in the following manner. Transport of the loose material 1 (FIG. 1), e.g. alumina, into the input zone 4 is carried out in the following manner. The material 1 from the bunker 12 enters the doser 13, e.g. of a voluminous type, from which along the pipeline 14 the material through the device 15 for input of the material into the space 16 of the gas-collecting bell 17 is fed into the input zone 4 where some layer 5 is formed from the material 1. The tool 6 is immersed in the aforesaid layer 5 and performs mechanical oscillations within the amplitude range of from about 1.0 to about 5.0 mm, created by the vibrator 19, and translatory motions towards the electrolyte 3 and back therefrom by means of the pneumatic membrane mechanism 21 ensuring the length of those motions in the range of values from about 10.0 to about 120.0 sec, e.g. 90.0 sec. This results in the creation of a vibrational field in the layer 5 of the material 1, which disturbs the links created during the hardening of the electrolyte 3, and thus keeps the material 1 input zone 4 unfrozen, which increases the capacity of the material 1 input zone 4.

The vibrational field increases the speed of feeding the material 1 into the electrolyte 3 by enhancing the wettability of particles of the material in the electrolyte 3 and by intensification of the proces of heating the loose material 1, which is in a vibrofluidized state, with hot anode gases. Wherein, the vibrofluidized state of material 1 in the aforesaid layer 5 is achieved by the small amount of applied power, e.g. 200–400 W.

The vibrating tool 6, performing multiple immersions in the layer 5 of the loose material 1, ensures its effective displacement and pushing into the electrolyte 3, increases the capacity of the material input zone 4 and ensures uniform and high speed supply of the material into the melt of the electrolyte 3.

The above-described combination of movement of the tool 6 into the layer 5 of the loose material 1 in the recommended time and amplitude ranges increases the speed and reliability of supplying the material 1 into the electrolyte 3 due to it being effectively pushed even in the presence of coal foam in the input zone 4, which foam, having a positive buoyancy, hinders the supply and dissolution of the material 1 in the electrolyte 3.

The method in accordance with the invention, when used with an electrolyzer to produce aluminum with a self-baking anode with a current of e.g. 160 kA, with an alumina consumption of about 1.6–1.7 kg/min, with an amplitude of mechanical oscillations of the tool about 5.0 mm and with a length of motion of the tool towards the electrolyte and back therefrom equal to 90 sec, with three material input zones, ensures their capacity at the level of 0..75 kg/min when using difficultly soluble finely crystalline alumina, and at the level of 1.5 kg/min when easily dissolved macrocrystalline alumina is used, while power consumption for feeding alumina into the electrolyte is reduced three times. Wherein, due to the steep and uniform buildups a good shape of the working space of the electrolyzer is maintained.

The proposed method for feeding alumina into the electrolyzer increases its productivity by 5–8%.

What is claimed is:

1. A method for feeding loose material, primarily alumina, into an electrolyzer for the production of aluminum, the method comprising the following steps:

forming at least one input zone for inputting of said material in a bell-shaped space of the electrolyzer on the surface of an electrolyte, providing a working tool for pushing said material into a melt of the electrolyte in said at least one input zone, imparting to the working tool mechanical oscillations and translatory motions back and forth from the electrolyte, the length of time of the motions being within the range of about 10.0 to about 120.0 sec, transporting said material to said at least one input zone for inputting of said material, forming a layer in said at least one input zone for inputting of said material, after accumulating a sufficient amount of said material in said layer, the material enters into contact with said working tool, as a result of which a vibrational field is created in said layer which hinders the formation of a crust on the electrolyte, and said material is pushed through said at least one input zone into the melt of the electrolyte.

2. The method for feeding as in claim 1 wherein said at least one zone for inputting of said material is disposed above a region of maximum thickness of the layer of electrolyte, which region is positioned along a side wall of an anode of the electrolyzer and limited on both sides relative to the transverse axis of the electrolyzer by one-sixth of its length.

3. The method for feeding as in claim 1 wherein the amplitude of vertical mechanical oscillations of said working tool is maintained within the range of values of from about 1.0 to about 5.0 mm.

4. The method for feeding as in claim 2, wherein the amplitude of vertical mechanical oscillations of said working tool is maintained within the range of values of from about 1.0 to about 5.0 mm.

5. The method for feeding as in claim 1, comprising a plurality of input zones.

* * * * *